United States Patent [19]

Vazquez, Jr. et al.

[11] Patent Number: 4,695,053

[45] Date of Patent: Sep. 22, 1987

[54] GAMING DEVICE HAVING PLAYER SELECTABLE WINNING COMBINATIONS

[75] Inventors: Hilario Vazquez, Jr.; Paul R. Yarnold, both of Chicago, Ill.

[73] Assignee: Bally Manufacturing Corporation, Chicago, Ill.

[21] Appl. No.: 837,422

[22] Filed: Mar. 7, 1986

[51] Int. Cl.[4] ..... A63B 71/04

[52] U.S. Cl. ..... 273/143 R; 273/138 A

[58] Field of Search ..... 273/143 R, 138 A, 1 E, 273/DIG. 28, 85 G, 143 B, 143 C, 143 D, 143 E

[56] References Cited

U.S. PATENT DOCUMENTS

| | | | |
|---|---|---|---|
| 3,770,269 | 11/1973 | Elder | 273/138 A |
| 3,834,712 | 9/1974 | Cox | 273/143 R |
| 4,238,127 | 12/1980 | Lucero et al. | 273/143 R |
| 4,648,600 | 3/1987 | Olliges | 273/DIG. 28 |

FOREIGN PATENT DOCUMENTS

| | | | |
|---|---|---|---|
| 0164877 | 12/1985 | European Pat. Off. . | |
| WO80/02512 | 11/1980 | PCT Int'l Appl. . | |
| 1275697 | 5/1970 | United Kingdom . | |
| 1445518 | 2/1974 | United Kingdom . | |
| 1347003 | 2/1974 | United Kingdom . | |
| 1428157 | 3/1976 | United Kingdom . | |
| 2078419 | 1/1982 | United Kingdom | 273/143 R |
| 2084371 | 4/1982 | United Kingdom | 273/143 R |
| 2106292 | 4/1983 | United Kingdom | 273/143 R |
| A2119989 | 11/1983 | United Kingdom . | |

*Primary Examiner*—Leo P. Picard
*Assistant Examiner*—MaryAnn Stoll Lastova
*Attorney, Agent, or Firm*—Mason, Kolehmainen, Rathburn & Wyss

[57] ABSTRACT

A gaming device of the type that utilizes multiple rotatable reels or a video display to display a random combination of predetermined symbols, and which issues a win indication or a payout whenever one of several predetermined winning combinations of symbols is obtained. Certain ones of the predetermined winning combinations of symbols are defined by the machine and others are player selectable.

10 Claims, 4 Drawing Figures

GAMING DEVICE HAVING PLAYER SELECTABLE WINNING COMBINATIONS

BACKGROUND OF THE INVENTION

1. Field of the Invention

The present invention relates to gaming devices that generate random combinations of symbols and provide a win indication if the random combination generated corresponds to one of a plurality of predetermined winning combinations, and more particularly to a gaming device wherein at least one of the winning combinations is player selectable.

2. Prior Art

There are several prior known gaming devices that have three to five rotatable reels arranged side by side. The outer periperal surfaces of the reels have disposed thereon a series of symbols, such as a lemon, a plum, a bell, a melon, a star, a cherry, a bar, or the like. Also machines having a video display instead of or in combination with the mechanical reels have become popular.

In both the mechanical and video type gaming devices, the player inserts a token, which may be a coin or the like, into the machine and starts the reels or the video display in motion by pulling a handle located on the side of the machine. After the reels have stopped or after the video display has stabilized, a determination is made as to whether the combination of displayed symbols matches one of several predetermined combinations. If a match is sensed, the machine will produce a particular combination or payout of a number of tokens in relation to the odds that that particular combination will occur.

While these machines provide a good deal of excitement to the player in attempting to obtain a winning combination, particularly one that has long odds and a high payout, the winning combinations are fixed by the machine and cannot be altered by the player.

SUMMARY OF THE INVENTION

Therefore, it is an object of the present invention to provide an improved gaming device that increases player participation.

It is another object of the present invention to provide a gaming device of the type described above wherein one or more winning combination may be selected by the player.

It is another object of the invention to provide a gaming device of the type that provides a win indication whenever any of the machine defined winning combinations or a player selected winning combination is obtained.

Therefore, in accordance with a preferred embodiment of the invention, there is provided a gaming device having a plurality of rotatable reels, or a video display equivalent thereof, for generating at random a combination of symbols, for example, three to five symbols depending on the number of reels used. Each of the reels has displayed on its periphery a plurality of pictorial symbols, for example, oranges, plums, bells, melons, stars, etc. During play, various ones of these symbols are displayed as the reels are rotated. After the reels stop rotating, if the displayed synbols correspond to one of the winning combinations of symbols defined by the machine, a win indication or a payout occurs.

In addition to the pictorial symbols discussed above, each of the reels or video display equivalent thereof contains a plurality of symbols that may be used to form a player selected winning combination. For example, in the preferred embodiment, the numerical symbols 0 through 9 are interposed between the pictorial symbols around the periphery of each of the reels. The device also includes a player operable input devices, such as, for example, a keyboard, containing keys that correspond to the aforementioned numerical symbols 0 through 9. The keyboard permits the player to select one of the numerical symbols 0 through 9 for each reel. The selected numerical symbols are displayed on a digital display to indicate to the player which numerical symbols was selected for each reel. Thus, the player may enter a player selectable winning combination in addition to the winning combinations already defined by the machine. A win indication is provided if any of the machine defined winning combinations is displayed, or if one or more of the player selected symbols is displayed. In a payout type of device, the amount of the payout is determined by the odds of obtaining a match, and in general, the more of the player selected symbols that are matched, the higher the payout.

BRIEF DESCRIPTION OF THE INVENTION

These and other objects and advantages of the present invention will become readily apparent upon consideration of the following detailed description and attached drawing wherein.

DETAILED DESCRIPTION

Figure 1:
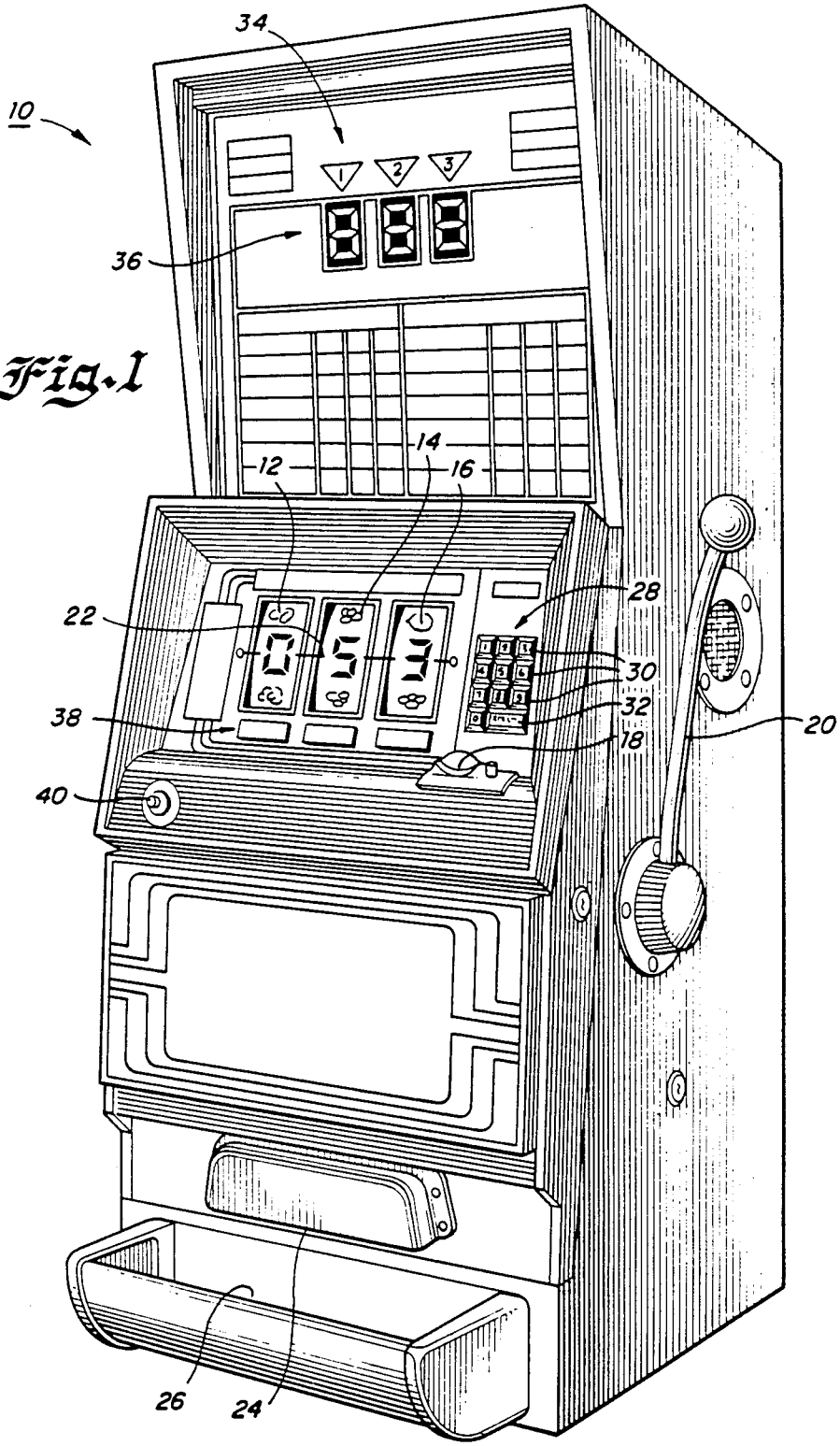
FIG. 1 is a perspective view of the gaming device according to the invention.

Referring now to the drawing, with particular attention to FIG. 1, there is shown a gaming device according to the invention generally designated by the reference numeral 10. The gaming device 10 includes three symbol bearing reels 12, 14 and 16. Although three symbol bearing reels are shown, it should be understood that more or fewer reels could be used, and that a video display or other display could be used to display the symbols; however, in this preferred embodiment three reels are used. To operate the device, a player inserts one or more tokens into a slot 18 and pulls a handle 20. Pulling the handle 20 causes the reels 12, 14 and 16 to rotate and after the reels stop rotating, random combination of symbols will appear beneath a win line 22. If the combination of symbols beneath the win line matches one of the machine defined combinations or a player selected win combination, a win occurs and the machine will dispense a predetermined number of tokens from a payout chutes 24 into a tray 26.

In order for the machine to accept the player selected winning combination, there is provided a keypad 28 containing a plurality of keyswitches 30. In the illustrated embodiment, each of the keyswitches 30 has one of the numerals 0 through 9 disposed thereon so that by depressing the key associated with a particular numeral, that numeral is selected; however, other symbols including alphabetic characters and pictorial symbols could also be used. A clear button 32 resets the select digit indicator 34 to the first reel when it is depressed, so that the player enters any or all numbers from left to right as illustrated on display 36. A digital display 36, which may be, for example, a seven segment digital display, such as, for example, a liquid crystal display, displays the selected digits. An instructional message indicator 38 displays predefined messages, for example, such as insert token, token accepted, for viewing by the player. An attendant button 40 is activated by the player to provide a visual indication for an attendant of the player's need for assistance, for example, such as requiring additional tokens.

In operation, the player selects a digit for each of the reels 12, 14 and 16. Typically, when the player inserts a token into the slot 18, reel one of the indicators of the select digit indicator 34 will become illuminated. Once activated by the token, the indicator 38 bearing the message token accepted will become illuminated. The indicator of the select digit indicator 34 corresponding to the particular player selected digit of the digital display 36 will be, for example, cyclically iluminated, flashing ON and OFF. The player may then enter the desired digit by depressing a particular keyswitch 30 of the keypad 28. After a number is selected via keypad 28, the corresponding select digit indicator 34 will remain continuously on, demonstrating to the player that a number for that corresponding reel has been selected. This sequence is repeated until all selections are made. Each time the keyswitch 30 is depressed the next digit is selected until the last digit has been selected. At this point another actuation of the clear button 32 allows the first digit to be selected again and the process may be repeated as often as desired. After the last digit has been selected, the player pulls the handle 20 to begin play. The player wins if any one of the reels 12, 14 or 16 displays the corresponding previously player selected digit. If two of the previously selected corresponding digits are matched, the number of tokens dispensed is increased, and if all three corresponding digits are matched, the winnings are greatly increased. The player may continue to play by putting an additional token or tokens into the slot 18 and pulling the handle. He may play as long as he desires with any set of selected digits, but if he wishes to change one or more of the selected digits, he may select the new digit or digits he wishes to select after inserting a token via the keyboard 28. A loudspeaker 42 generates appropriate sound effects as the game is being played.

Figure 2:
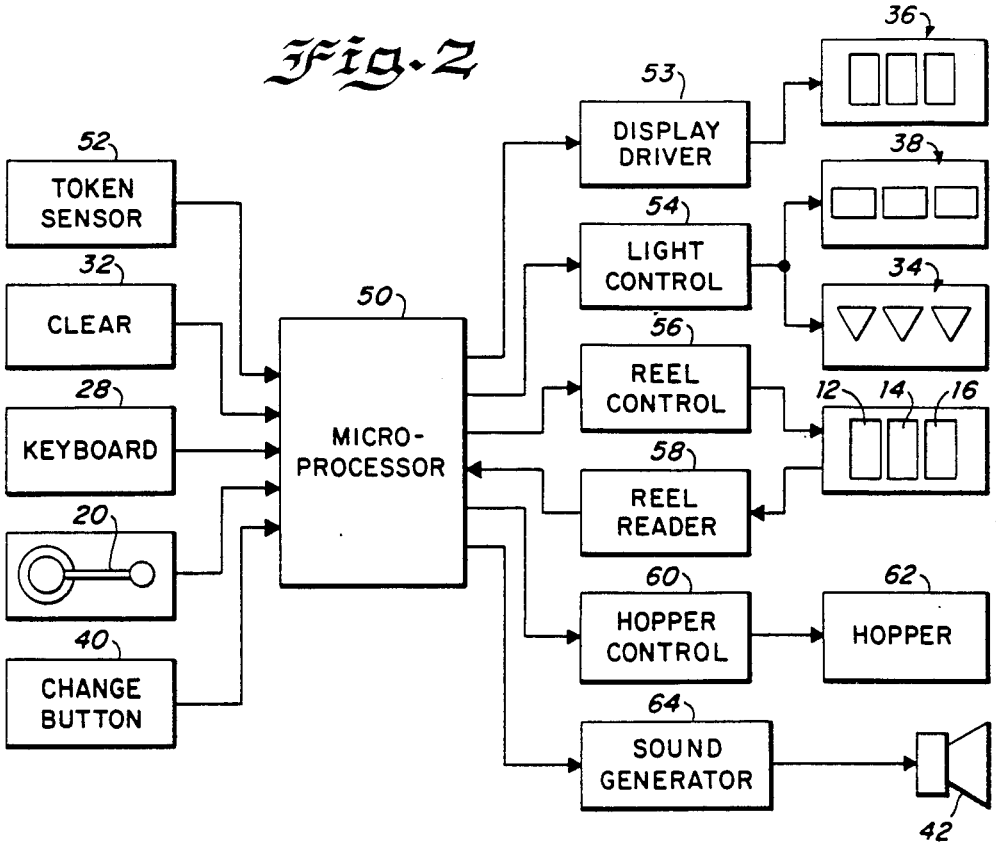
FIG. 2 is a logical block diagram of the gaming device according to the invention.

Referring now to FIG. 2, in the preferred embodiments the operation of the gaming device according to the invention is controlled by a microprocessor 50. Various microprocessors having standard capabilities may be employed, however, the Intel 8088 of the Motorola 68000 series processors advantageously may be used for the microprocessor 50. The microprocessor 50 receives signals representative of the position of the arm 20 as well as signals from the keyswitches 30 and 32 of the keyboard 28. In addition, a token sensor 52 provides a signal to the microprocessor 50 each time a token is deposited in the slot 18. The microprocessor 50 controls the display 36 via a display driver 53, and controls the sequencing of the digit select lights 34 and message indicator 38 by means of a light control 54. The reels 12, 14 and 16 are controlled by the microprocessor via a reel control circuit 56, and the position of each of the reels 12, 14 and 16 is read by a reel reader 58, and the position information is relayed by the reel reader 58 to the microprocessor 50 to provide to the microprocessor 50 an indication of the position of each of the reels 12, 14 and 16. The reel reader 58 may employ standard shaft position techniques utilizing shaft encoders such as magnetic shaft encoders or other shaft encoders well known in the art. The reel control 56 is responsive to pulses from the microprocessor 50 and separately actuates a solenoid (not shown) associated with each of the reels 12, 14 and 16 to advance the reels 12, 14 and 16, respectively, one increment for each pulse applied to the reel control 56.

A hopper control circuit 60 feeds the appropriate number of tokens to a hopper 62 under the control of the microprocessor 50 and activates a motor in the hopper 60 to cause the winnings to be dispensed through the chute 24 into the tray 26 (FIG. 1). A sound generator 64 generates the appropriate playing sounds under the control of the microprocessor 50 and applies them to a transducer such as the loudspeaker 42.

In operation, the microprocessor 50 senses the deposit of a coin via the coin sensor 52 and enables the clear button 32 and the keyboard 28 in response thereto. The player then selects a number for each digit via the keyboard 28 and the clear button 32. The selected digits are indicated by the select digit indicators 34 and 38 and the selected number for each digit will be displayed on the display 36. Once all of the digits have been selected, play is initiated by actuating the handle 20; however, if the player wishes to change any of the selected digits he may do so by depressing the clear button 32 and entering the new number sequence via the keyboard 28 prior to actuating the handle 20.

When the handle 20 is actuated, is microprocessor generates three random numbers by applying random numbers of pulses to the real control 56 that determine the number of increments each of the respective reels 12, 14 and 16 will be advanced. After the reels 12, 14 and 16 have been advanced the appropriate number of increments, the reel reader 58 reads the position of the reels and relays that position information to the microprocessor 50. The microprocessor compares the position information with winning combinations stored in the memory of the microprocessor 50. These winning combinations includes fixed winning combinations correspoding to the unalterable symbols on the reels such as the bell, plum, melon, star, etc., previously discussed as well as the combination of numbers entered by the player. If a match occurs, the value of that match, previously stored in memory, is looked up and the appropriate number of tokens are dispensed from the hopper 62 under control of the hopper control 60. The sound generator 64 will generate a win indicating signal and apply it to the loudspeaker 42.

Figure 3:
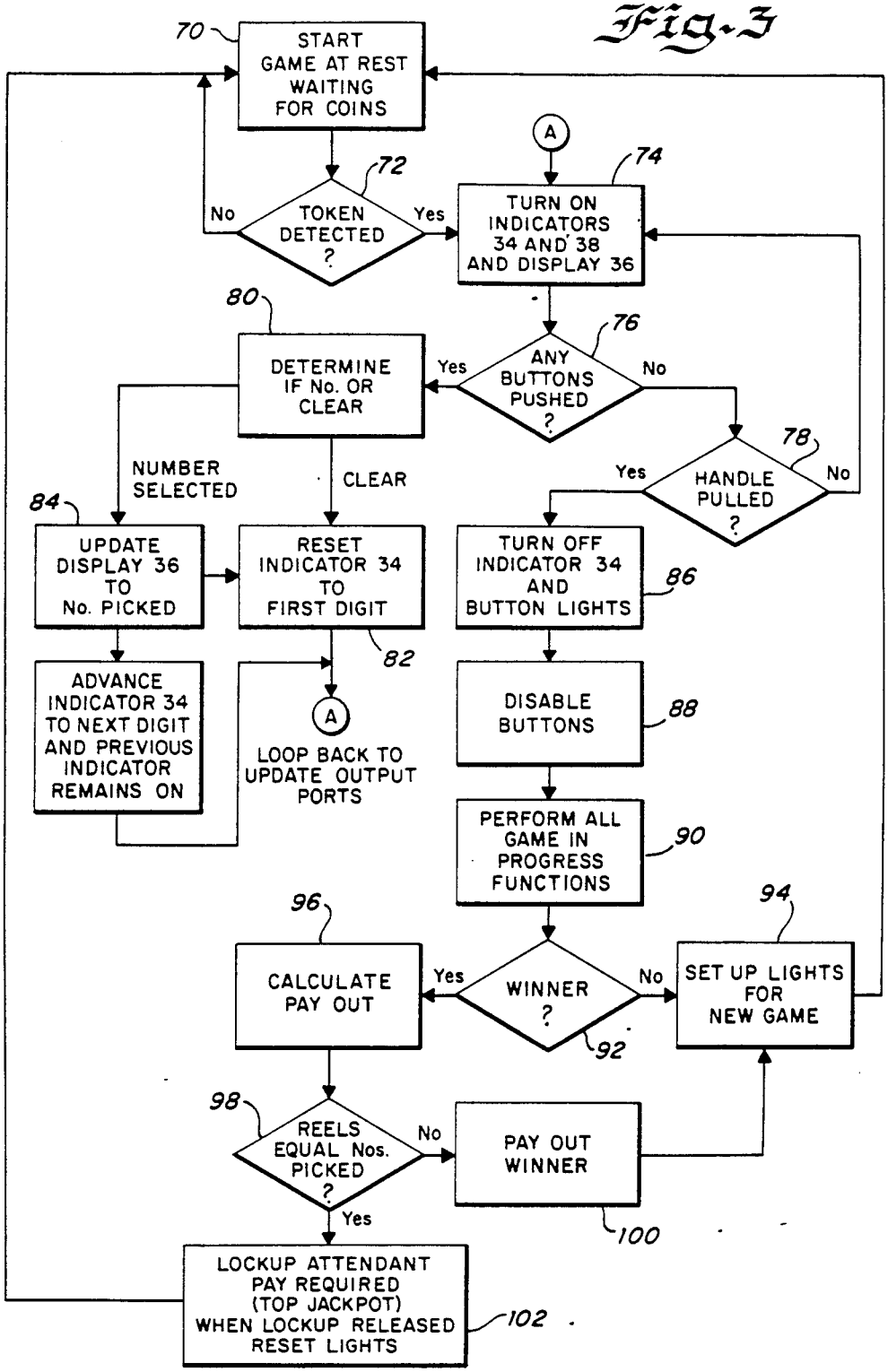
FIG. 3 is a logical flow diagram illustrating the logic functions performed by the logic illustrated in FIG. 2.

Referring now to FIG. 3, the operation of the gaming device 10 will be described with reference to the flow chart shown in FIG. 3. As indicated in a block 70, the sequence begins with the machine 10 at rest or idle and ready to accept one or more tokens. The player starts a game by inserting a desired number of tokens, for example, one two or three tokens. The microprocessor 50 monitors the token sensors 52 to determine if a token is detected, as indicated in a block 72. When the player deposits one or more tokens the various required lights such as the digit indicator 34 and message indicator 38 are illuminated, as indicated in a block 74. The microprocessor 50 stores the number of tokens detected by the token sensor 52 for later use in calculating a payout that may result from the game. The device is now ready to accept information from the keyswitches 30 and clear button 32, in the keyboard 20. As indicated in a block 76, a decision is made whether any of the switches 30 and 32 have been activated by the player. When none of the switches 30 and 32 are actuated by the player, the numbers selected for a previous game are displayed on the display 36 and a decision is made whether the handle 20 has been pulled by the player as indicated in a block 78. Otherwise, once any button has been pushed, a determination is made whether the button pushed was a clear button 32 or a number selection button 30, as indicated in a block 80. If the button pushed is the clear button 32, as indicated in a block 82, the digit indicator 34 is set to the first reel. If a number is selected, as indicated in a block 84, that selected number is displayed on the display 36 in the corresponding digit position and the digit indicator 34 is advanced to next digit (block 82). The device remains responsive to the clear and number select buttons until the handle 20 is pulled, as indicated in the block 78.

When a decision is made that the handle 20 has been pulled, the lights for keyswitches 30 and 32 and indicator 34 are turned off, as indicated in a block 86. As indicated in a block 88, the keyswitches 30 and 32 are then disabled or ignored. All of the game in progress functions are then performed, as indicated in a block 90. These include the generation of the random numbers associated with each of the reels 12, 14 and 16, advancing the reels the corresponding number of steps and sensing the final position of the reels. During this time, various sound effects may be generated by the sound generator 64 and applied to the loudspeaker 42, and various lights on the device may be flashed to provide more player interest.

After the game in progress functions have been performed, the final position of the reels is determined, compared with the fixed as well as player enterable winning combinations to determine whether a winning combination has occurred, as indicated in a block 92. If not, the device resets the instructional indicator 38 and returns to its rest condition (block 70) and is ready for a new game when another coin is deposited. If a winning combination is indicated, the value of that combination or payout is calculated, as indicated in a block 96. The stored number corresponding to the number of tokens played is utilized to calculate the payout. The numbers displayed on the reels 12, 14 and 16 are compared with the player selected numbers, as indicated in a block 98. If fewer than all three reels match the player selected winning combination, the appropriate winnings are dispensed from the hopper 62, as indicated in a block 100, and the device returns to rest (block 70). If, however, the top prize is won, that is each of the reels matches the player selected number a win indication is provided, as indicated in a block 102. This indication may be a flashing of lights as well as accompanying audio presentation via the loudspeaker 52 which will be noticed by an attendant who will pay the player the jackpot prize and then manually release the machine by means of a key or other device (not shown) to enable the machine again for a new game (block 70).

While the embodiment illustrated in FIGS. 1 and 2 is an electromechanical embodiment which provides interest because of the mechanical sounds and movements, it is also possible to implement the present invenion in other ways.

Figure 4:
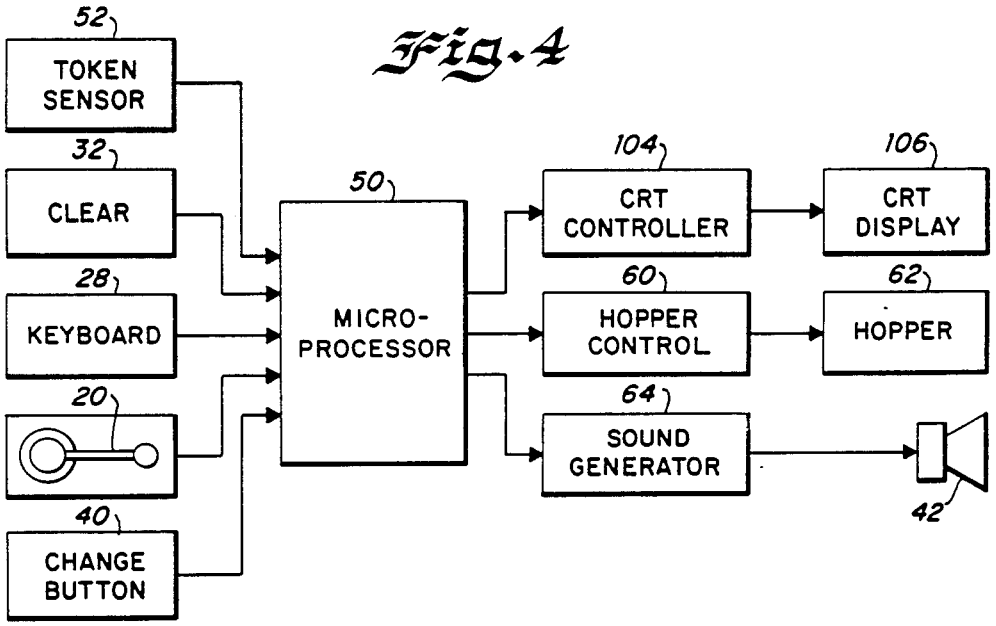
FIG. 4 is a logical block diagram of an alternative gaming device according to the invention.

Referring now to FIG. 4, an alternative embodiment is illustrated and generally designated by a reference numeral 10'. The same reference numerals are used for similar components of the gaming device 10' as used in FIGS. 1 and 2. In the alternative gaming device 10', the reels 12, 14 and 16, and associated circuitry including the reel control 56 and the reel reader 58 may be replaced by an alternative display, such as, for example, a cathode ray tube CRT controller 104 and a cathode ray tube CRT display 106. The CRT controller 104 generates video signals for displaying on the CRT 106 corresponding to the numeric and pictorial symbols as before described with respect to the reels 12, 14 and 16, the select digit indicator 34, the selected digit display 36 and the instructional message display 38. An integrated circuit CRT controller device such as the Motorola device MC6845 may be used for the CRT controller 104. An analogous game sequence as illustrated in the flow chart in FIG. 3 is preformed by the gaming device 10'.

Although the present invention has been described in connection with details of the preferred embodiment, many alterations and modifications may be made without departing from the invention. Accordingly, it is intended that all such alterations and modifications may be considered as within the spirit and scope of the invention as defined in the appended claims.

What is clamed and desired to be secured by Letters Patent of the United States is:

1. In a gaming device of the type having means for generating a random combination of symbols, means defining a plurality of winning combinations of symbols and means resonsive to said random combination generating means and to said winning combination defining means for providing an indication of a win whenever the generated random combination corresponds to one of said winning combinations, the improvement comprising:

player operated means for generating a player selected winning combination;

means responsive to said player selected combination for providing an indication of a win whenever the generated random combination corresponds to said player selected winning combination; and wherein said random combination generating means includes a plurality of rotatable reels, each reel having disposed thereon a plurality of first symbols corresponding to symbols defining said winning combination and second symbols corresponding to symbols defining said player selected said winning combinations and said second symbols being different from said first symbols.

2. The improvement as recited in claim 1 wherein the first symbols corresponding to winning combinations include pictorial symbols and the second symbols corresponding to the player selected winning combination include numerical symbols.

3. The improvement as recited in claim 1 wherein said random combination generating means includes display means for sequentially displaying a plurality of combinations of predefined symbols corresponding to both the defined winning combinations and said player selected winning combination.

4. The improvement as recited in claim 3 wherein the predefined symbols corresponding to winning combinations include pictorial symbols and the symbols corresponding to the player selected winning combination include numerical symbols.

5. The improvement as recited in claim 1 further comprising means for detecting at least one player depositing token means for storing a number responsive to detected tokens, and means for determining a payout proportional to said stored number responsive to said indication of a win.

6. The improvement as recited in claim 1 wherein said player operated means for generating a player selected winning combination includes switch means for selecting symbols in a predefined series.

7. The improvement as recited in claim 6 wherein said symbols include numerical symbols.

8. The improvement as recited n claim 6 wherein said predefined series includes three symbols.

9. The improvement as recited in claim 6 wherein said predefined series includes five symbols.

10. The improvement as recited in claim 6 wherein said predefined series includes four symbols.

* * * * *